US007809296B2

(12) United States Patent
Kolb

(10) Patent No.: US 7,809,296 B2
(45) Date of Patent: Oct. 5, 2010

(54) PRINTING DEVICE TONER CONTROL INCLUDING REST RECOVERY SYSTEM, METHOD AND ALGORITHM

(75) Inventor: Kurt Robert Thor Kolb, Hillingdon (GB)

(73) Assignee: Xerox Corporation, Norwalk, CT (US)

( * ) Notice: Subject to any disclaimer, the term of this patent is extended or adjusted under 35 U.S.C. 154(b) by 690 days.

(21) Appl. No.: 11/776,743

(22) Filed: Jul. 12, 2007

(65) Prior Publication Data

US 2009/0016745 A1 Jan. 15, 2009

(51) Int. Cl.
*G03G 15/08* (2006.01)

(52) U.S. Cl. ..... 399/58; 399/61

(58) Field of Classification Search ..... 399/27, 399/30, 58, 61, 62, 29, 258, 259
See application file for complete search history.

(56) References Cited

U.S. PATENT DOCUMENTS

2001/0017991 A1* 8/2001 Kobayashi et al. ..... 399/61
2003/0118358 A1* 6/2003 Ko ..... 399/27
2004/0184826 A1* 9/2004 Ozawa et al. ..... 399/30

* cited by examiner

*Primary Examiner*—David P Porta
*Assistant Examiner*—Milton Gonzalez
(74) *Attorney, Agent, or Firm*—Oliff & Berridge, PLC

(57) ABSTRACT

A method and computer program for preventing excess supply of toner in an imaging device include detecting a change in a tribo-electric charge of toner after a period of inactivity of the imaging device, compensating a toner dispense control value, such as a PID (Proportional, Integral, Differential) value, based on the detected change in the tribo-electric charge of toner, and outputting the compensated toner dispense control value. A system for preventing excess supply of toner includes a sensor that detects a change in a tribo-electric charge of toner after a period of inactivity of the imaging device, and a controller that compensates the toner dispense control value based on the detected change in the tribo-electric charge of toner and outputs the compensated toner dispense control value. The detected change may be based on a charge prior to the inactivity.

14 Claims, 4 Drawing Sheets

PRINTING DEVICE TONER CONTROL INCLUDING REST RECOVERY SYSTEM, METHOD AND ALGORITHM

BACKGROUND

The disclosure relates to a rest recovery system that controls toner concentration by taking into account imaging device inactivity, which causes stabilization in toner concentration. This prevents an erroneous addition of toner due to a perceived low concentration.

An algorithm may be used to directly detect a change in charged state of the toner from resting and prevent erroneous addition of toner.

SUMMARY

An imaging device, such as a xerographic machine, becomes inactive when not in use. When the imaging device becomes inactive for a long period of time or enters into a rest period, the imaging device is often put into a "sleep mode" in which most of the electric power is cut off to save energy. When the imaging device "wakes up" from the sleep mode, the device starts warming up and performs imaging operations with toner.

The toner used in such an imaging device is charged by a tribo-electric charge (also known as tribo). A toner concentration (TC) sensor measures the permeability of a toner-carrier mixture, which is determined by the toner concentration and charge of the toner. Based on the output of the TC sensor, a toner dispenser may adjust the supply of toner to increase the concentration of the toner when the concentration of toner is low. Although sensitive to toner concentration, many TC sensors are also sensitive to toner charge.

Toner concentration in a developer housing is an important factor in image quality. However, the tribo-electrostatic state has a large influence in both image quality and the sensor needed for feedback control. During periods of rest, the toner charge decays, leading to darker images. This appears to a permeability sensor to be a drop in toner concentration. In a PID (Proportional, Integral, Differential) controller, this apparent drop leads to an excess in added toner because the proportional error from a target is great until the charge builds a steady state.

Thus, if the imaging device is inactive for a long period of time, such as from the end of a business day to the next morning, the tribo-electric charge of the toner may drop over time. Various TC sensors may interpret this drop in charge as a drop in toner concentration in the developer. As a result, upon turning on the imaging device, a controller may instruct the toner dispenser to supply more toner to the developer, thereby resulting in high or excessive toner concentration in the developer. This combination of low toner charge and increased toner concentration can lead to poor print quality, usually being too dark (high) of a background for several hundred prints. Therefore, the image quality in an imaging operation during this start up period may be inconsistent with excessive toner than the image quality during normal or continual use of the imaging device.

The exemplary embodiments address these and other issues. For example, in various exemplary embodiments, an algorithm for control is provided that is simple and insensitive to toner changes as it directly measures sensor change during a rest activity. In other exemplary embodiments, a method for preventing excess supply of toner in an imaging device may include detecting a change in a tribo-electric charge of toner after a period of inactivity of the imaging device, compensating a toner dispense control value based on the detected change in the tribo-electric charge of toner, and outputting the compensated toner dispense control value. In an exemplary embodiment, the toner dispense control value may be a PID (Proportional, Integral, Differential) value.

Further, in various exemplary embodiments, a system for preventing excess supply of toner in an imaging device may include a sensor that detects a change in a tribo-electric charge of toner after a period of inactivity of the imaging device, and a controller that compensates a toner dispense control value based on the detected change in the tribo-electric charge of toner and outputs the compensated toner dispense control value.

Furthermore, in various exemplary embodiments, a program stored in a computer readable storage media may include an instruction for detecting a change in a tribo-electric charge of toner after a period of inactivity of the imaging device, an institution for compensating a toner dispense control value based on the detected change in the tribo-electric charge of toner, and an instruction for outputting the toner dispense control value.

These and other features and advantages of the disclosed embodiments are described in, or are apparent from, the following detailed description of various exemplary embodiments.

BRIEF DESCRIPTION OF THE DRAWINGS

Various exemplary embodiments of disclosed systems and methods will be described, in detail, with reference to the following figures, wherein.

DETAILED DESCRIPTION OF EMBODIMENTS

Figure 1:
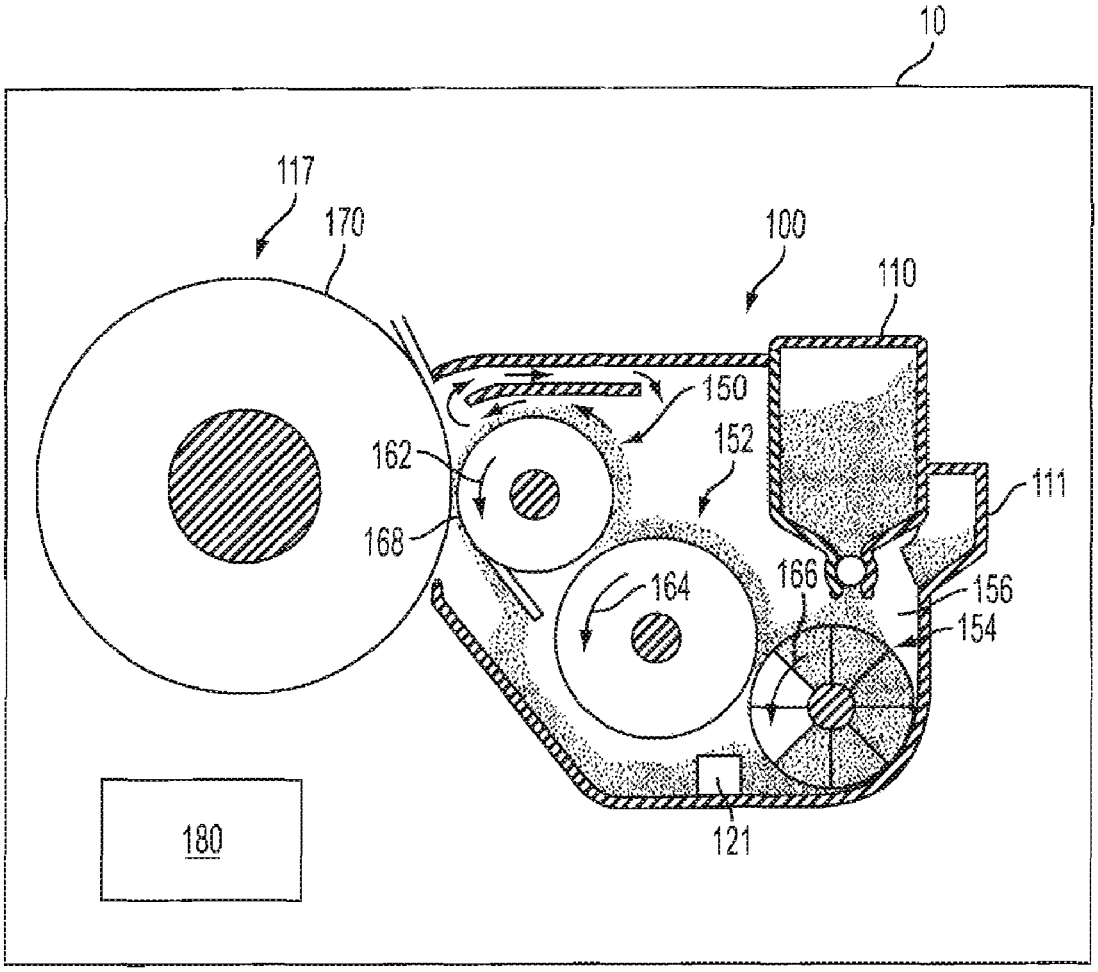
FIG. 1 illustrates a toner and developer supply system according to an exemplary embodiment.

Toner concentration in a developer is an important factor in image quality and needs to be controlled. The tribo-electric state of toner has a large influence on both the image quality and the TC sensor needed for feedback control. During periods of inactivity of an imaging device, such as a printer, the tribo-electric charge of the toner decays exponentially with time. Such decays may be interpreted by a TC sensor to be a drop in toner concentration. A toner dispense controller, such as a PID (Proportional, Integral, Differential) controller, for example, may then instruct additional toner be added, leading to excess toner dispensed. The PID controller instructs the adding of toner because the proportional error from the target is great after the long periods of device inactivity due to a reduction in toner charge until the charge builds to a steady state after a warm up period upon reuse of the device. Periods of repeated inactivity may thus lead to excessive toner concentration due to perceived low toner concentration.

An algorithm according to exemplary embodiments is simple and insensitive to toner changes because it can directly measure the toner charge during periods of inactivity. For example, a change in charge of the toner may be detected by a TC sensor. This change may be used to determine the offset to be used to compensate undue PID control action, that is, to restrict the controller from adding excess toner. According to this algorithm, both the proportional and integral terms are related to the drop in voltage of toner charge during the rest or inactivity period. The proportional and integral terms are balanced or compensated by selecting appropriate values for the proportional, integral, and rest recovery coefficients.

The algorithms according to the exemplary embodiments address problems associated with current algorithms, which either limit the PID control from adding an unnecessary amount of toner to the developer, or predict the charge decay and thus the drop in charge of the toner to offset the positive proportional control action with negative integral action. In the latter case, the offset may be effective only if one can accurately estimate how rest time or periods of inactivity relate to the change in toner charge. In reality, however, it may be difficult to accurately estimate the charge decay because of various conditions, such as toner batch variation, toner aging, environmental changes and the charged state before resting. However, exemplary embodiments of the disclosure can compensate for the period of inactivity, without predicting the toner's change in charged state.

In various exemplary embodiments, the tribo-electric charge of toner is compensated and maintained at the toner charge of normal operation. Using a rest recovery method for controlling the tribo-electric charge of toner, problems associated with periods of inactivity may be reduced or overcome. In various exemplary embodiments, the imaging device includes, but is not limited to, a printer, copier, fax machine and any other printing or xerographic device that may need toner concentration monitoring and control.

Details of such an imaging device and a toner charging mechanism are described in, for example, U.S. patent application Ser. No. 11/776,740, now U.S. Pat. No. 7,630,660, which is incorporated herein by reference in its entirety.

While the present disclosure will be described in connection with exemplary embodiments thereof, it will be understood that it is not intended to limit the disclosure to any one embodiment. On the contrary, it is intended to cover all alternatives, modifications, and equivalents as may be included within the spirit and scope of the disclosure as defined by the claims.

FIG. 1 illustrates an exemplary structure of a developer housing 100 of an imaging device 10. As depicted therein, the developer housing 100 may include a developer roller 150, a transport roller 152, and a paddle wheel conveyor 154. The developer roller 150, transport roller 152, and the paddle wheel conveyor 154 may be disposed in a chamber 156 of the developer housing 100. As the toner and developer are dispensed from a toner container 110 and a developer container 111, the mixture of the toner and developer is dispensed over the paddle wheel conveyor 154 so as to be intermixed with the carrier granules contained therein, forming a fresh supply of developer material.

The developer roller 150 may include a non-magnetic tubular member over a magnetic rotor and may be rotated in the direction of arrow 162. Similarly, the transport roller 152 may be made from a non-magnetic tubular member over a magnetic rotor and may be rotated in the direction of arrow 164. The exterior circumferential surface of the tubular member of the transport roller 152 may be roughened to facilitate developer material movement.

The paddle wheel conveyor 154 intermingles the fresh supply of toner particles with the carrier granules so as to form a new supply of developer material. The paddle wheel conveyor 154 may be made from a hub having a plurality of substantially equally spaced vanes extending radially outwardly therefrom and may be rotated in the direction of arrow 166, in this way, the toner particles may be advanced to the transport roller 152. The rotation of the paddle wheel 154, the transport roller 152 and the developer roller 150 may move the developer material into a development zone 168. In the development zone 168, the toner particles may be attracted from carrier granules to the electrostatic latent image recorded on a photoconductive surface 170 of a drum 117.

The developer housing 100 may include a toner concentration sensor (TC sensor) 121 to monitor the concentration of the mixed toner and developer. If the TC sensor 121 determines that the concentration of the developer for the supplied amount of the toner is low or deficient, then a signal may be sent to a controller 180, which may be used to increase the supply of the toner so as to adjust the concentration of the toner to a predetermined amount. An optimal or desired concentration level may be predetermined and may be color or system dependent.

According to an exemplary embodiment, the tribo-electric charge of the toner is monitored by the TC sensor 121 before and after a long inactivity period (rest period), so that an excess supply of toner is prevented. A method of preventing the excess supply of toner is discussed below.

According to an embodiment of the disclosure, the method may assume that the system at t=0 is "warmed up" and at a steady state with no PID controller action initially required to maintain control.

In the following explanation for compensating a toner dispense control value, such as a PID value, the following references are used: P is a proportional constant, R is a rest recovery constant, I is an integral constant, D is a differential constant, E is an error between a target voltage and measurement of the TC sensor, AE is an accumulated error of the error E for integration, ΔE is a change in error since last time step, and ΔV is a change in voltage measured by the TC sensor during a period of inactivity or rest.

In a PID controller implemented in discrete time domain (also known as Z-domain), a PID value is calculated as follows:

$$PID=P*E+I*AE+D*\Delta E \tag{1}$$

The accumulated error for integration and the change in error between the desired or target charge voltage of toner and the measured or actual charge of the toner by the TIC sensor 121 at each discrete time step may be calculated using the following equation:

$$AE_n=AE_{n-1}+E \tag{2}$$

$$\Delta E=E_n+E_{n-1} \tag{3}$$

where E=0, AE=0, and ΔE=0 during steady state with perfect control. However, the values A, AE, ΔE may not be zero.

During a rest period or a period of inactivity, a change in the voltage ΔV, measured by the TC sensor, may lead to a proportional action of P*ΔV. The algorithm according to an exemplary embodiment alters the accumulated error for integration (AE term) at the start-up of the imaging device, such that $AE=AE_{n-1}+R*\Delta V$, Then, the integral action may be I*AE=I*R*ΔV, where R is a negative number.

The charging of the toner leads to a drop in the measured value of the voltage (as taken by the sensor) asymptotically approaching a fully charged steady state. The sensor voltage with time may be determined by the following equation:

$$V(t)=\Delta V*e^{-t/\tau} \tag{4}$$

Where t is time and τ is the decay time constant.

Thus, the PID components may be determined as follows:

$$P(t)=P*\Delta V*e^{-t/\tau} \tag{5}$$

$$I(t)=I*(R*\Delta V+\Delta V*\tau-\Delta V*\tau*e^{-t/\tau}) \quad (6)$$

$$D(t)=-D*(\Delta V/\tau)*e^{-t/\tau} \quad (7)$$

For a balanced system that may ignore changes in the sensor voltage due to rest, the sum of proportional, integral, and differential terms may be zero for all times, and the accumulated error may reach zero eventually. To satisfy the latter condition, I (t)=0 where t is infinity. Thus:

$$R=-\tau \quad (8)$$

For the sum of PID terns to be zero at ally time and the total PID action to be zero, and substituting the above relation, the equations reduce to the same statement:

$$PID(t) \text{ or } PID_{total}=0=P+I*R+D/R \quad (9)$$

In a simple PID system (I=0), this reduces to D=−P*R or P*τ. Similarly, in a PI system (D=0), this may reduce to I=P/τ or −P/R. To have a full PID system, D and I terms may be halved and determined as follows:

$$D=-P*R/2 \quad (10)$$

$$I=-P/2R \quad (11)$$

Therefore, the full equation reduces to:

$$\begin{aligned} PID(t) \text{ or } PID_{total} &= P-P*R/2R-P*R/2R \quad (12) \\ &= P-P/2-P/2 \\ &= 0 \end{aligned}$$

where value P may be chosen independently using normal tuning rules. For example, the well-known Ziegler-Nichols technique provides a method for tuning a PID controller but adjusting the P term to a point where the output under control begins to oscillate.

Figure 2:
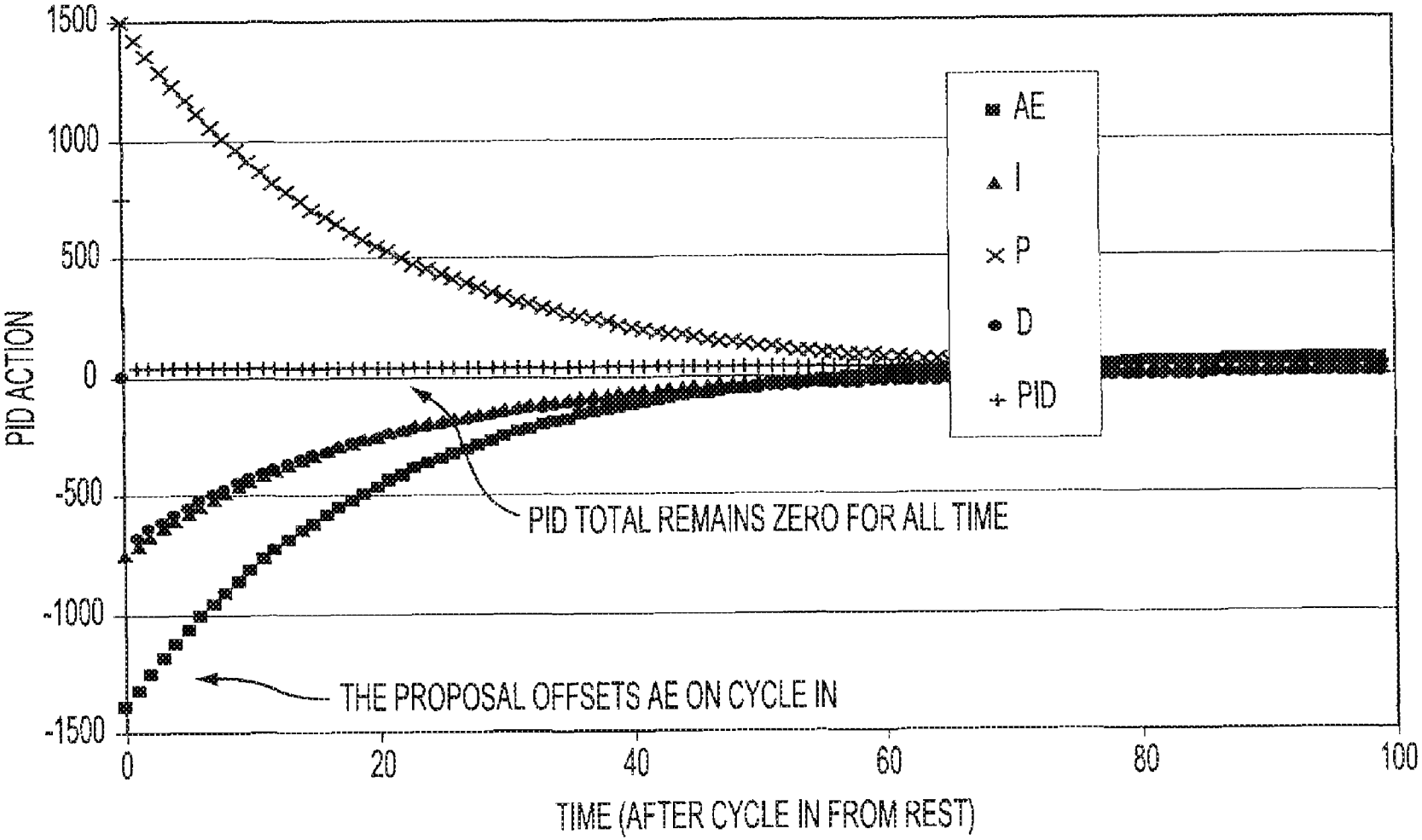
FIG. 2 illustrates a graph of optimized PID values for rest recovery according to an exemplary embodiment.

FIG. 2 illustrates a graph showing the relationships between values AE, I, P, D and PID over time. As shown in FIG. 2, PID total remains substantially zero for all times. This is because the offset to the AE, term balances the normal reaction of the P and D term to the change in TC sensor voltage after a rest period.

Figure 3:
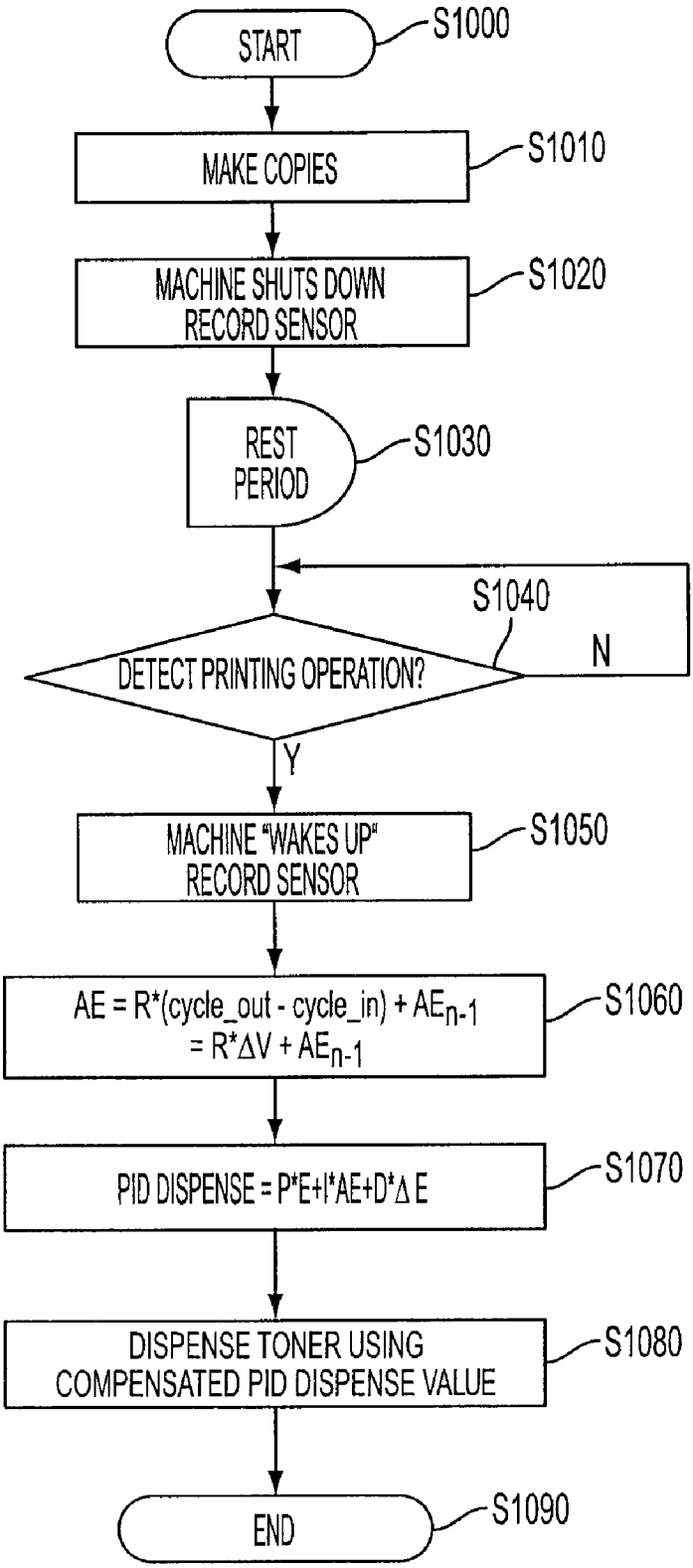
FIG. 3 illustrates a flowchart of a method of calculating the PID value according to an exemplary embodiment.

FIG. 3 illustrates a flowchart of a process for calculating a value of the PID. The process starts at S1000 and continues to S1010. As shown at S1010, the user performs imaging operations.

Then, as shown at S1020, the activity of the imaging device is detected, and the imaging device cycles out or stops its activity, and enters into an inactive state. The TC sensor voltage is recorded in a storing section of the printing machine. Then, the printing machine enters a rest period or a period of inactivity as shown at S1030.

As shown at S1040, a determination may be made as to whether an imaging operation is detected. That is, a determination may be made as to whether the user has activated the printing machine to recover from the rest period. If the printing operation is detected, the process continues as shown at S1050. If the printing operation has not been detected, then the process repeats the determination as shown at S1040.

As shown at S1050, the imaging device cycles in or "wakes up," and the TC sensor voltage is recorded. Then, as shown at S1060, an accumulated error for integration is determined as discussed above. That is, the accumulated error AE is determined as AE=R*(cycle_out−cycle_in)+$AE_{n-1}$=R*ΔV+$AE_{n-1}$.

Furthermore, as shown at S1070, the toner dispense control value, such as the PID dispense value, is determined using equation (1), which Includes the accumulated error. That is, PID dispense=P*E+I*AE+D*ΔE. As shown at S1080, the toner is dispensed using the compensated PID dispense value by outputting the compensated PID dispense value to a toner dispensing system. The process then ends as shown at S1090.

Figure 4:
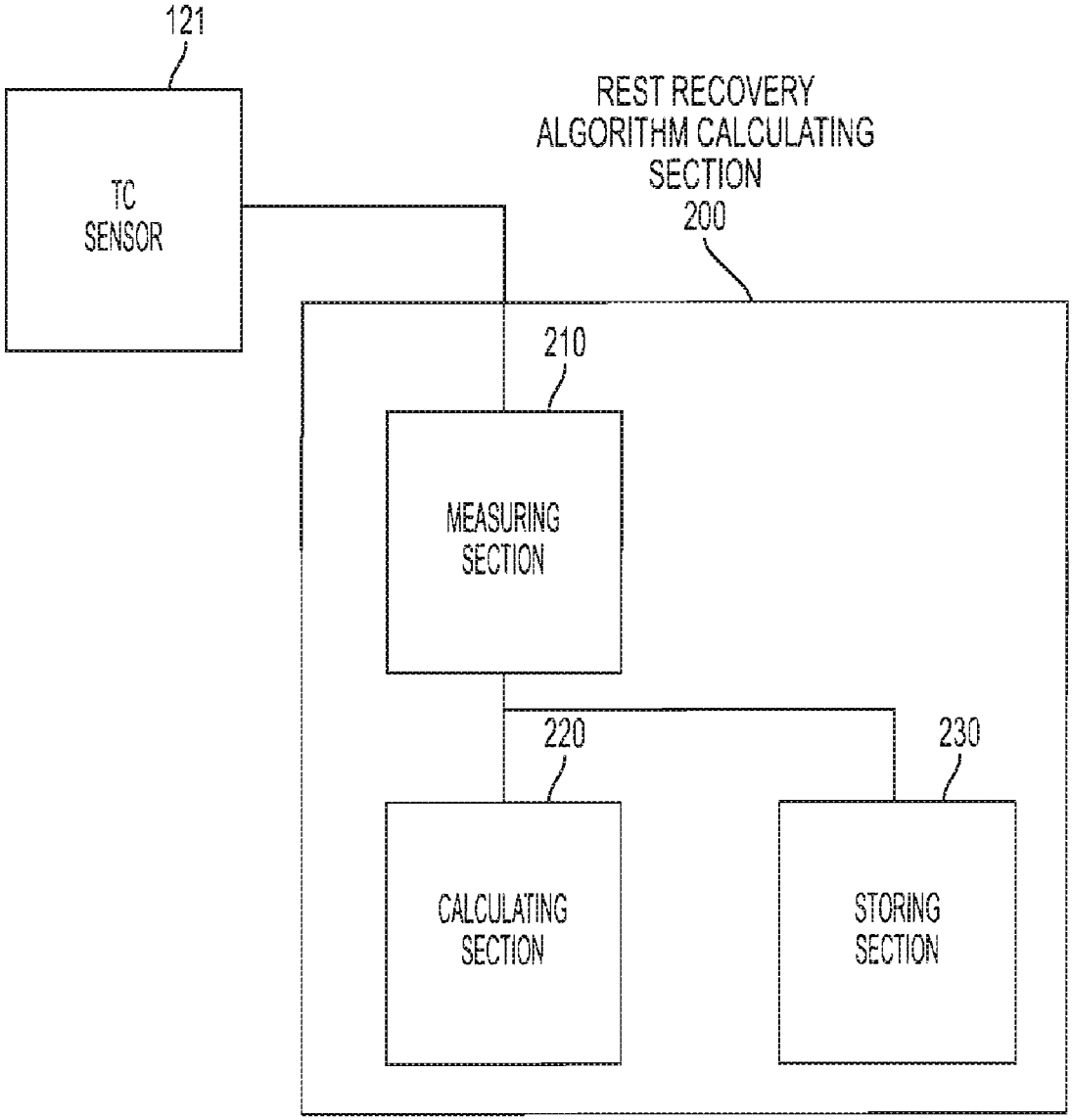
FIG. 4 illustrates a block diagram showing a rest recovery algorithm calculation section according to an exemplary embodiment.

FIG. 4 illustrates a block diagram for a rest recovery algorithm calculating section 200. The rest recovery algorithm calculating section may include a measuring section 210, a calculating section 220, and a storing section 230.

The measuring section 210 may read a sensor level of the TC sensor 121 to detect a change in the tribo-electric charge of toner. The calculating section 220 may calculate the PID value as discussed above, based on the detection of the change by the measuring section 210, to calculate the error values. The storing section 230 stores the result of compensation calculated by the calculating section 220.

The disclosed methods may be readily implemented in software, such as by using object or object-oriented software development environments that provide portable source code that can be used on a variety of computer or workstation hardware platforms. Alternatively, appropriate portions of the disclosed rest recovery system may be implemented partially or fully in hardware using standard logic circuits or a VLSI design. Whether software or hardware is used is dependent on the speed and/or efficiency requirements of the system, the particular function, and the particular software or hardware systems or microprocessor or microcomputer systems being utilized. The processing systems and methods described above, however, can be readily implemented in hardware or software using any known or later developed systems or structures, devices and/or software by those skilled in the applicable art without undue experimentation from the functional description provided herein together with a general knowledge of the computer arts.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for preventing excess supply of toner in an imaging device, the method comprising:

detecting a change in a tribo-electric charge of toner with a sensor after a period of inactivity of the imaging device;

calculating a toner dispense control value from the detected change in the tribo-electric charge of toner using an accumulated error value;

compensating the toner dispense control value based on the detected change in the tribo-electric charge of toner;

outputting the compensated toner dispense control value; and wherein the toner dispense control value is a PID (Proportional, Integral, Differential) value, the values P, I and D for the PID value are determined such that the compensated PID value is substantially zero, and the values P, a proportional constant, I, an integral constant, and D, a differential constant, are calculated by the following equations:

$$P(t)=P*\Delta V*e^{-t/\tau}$$

$$I(t)=I*(R*\Delta V+\Delta V*\tau-\Delta V*\tau*e^{-t/\tau})$$

$$D(t)=-D*(\Delta V/\tau)*e^{-t/\tau}$$

where R is a rest recovery constant, ΔV is a change in sensor voltage during rest, t is a measure of the period of inactivity of the imaging device and τ is a time constant; and the PID value is calculated by the following equation:

$$PID=P(t)*E+I(t)*AE+D(t)*\Delta E$$

where E is an error between a target voltage and a measurement voltage of the sensor, AE is an accumulated error of E, and ΔE is a change in error since a last measurement.

2. The method according to claim 1, wherein the change in the tribo-electric charge of toner is detected using a toner concentration (TC) sensor.

3. The method according to claim 1, wherein the toner dispense control value is calculated based on a plurality of changes in the toner charge detected at a plurality of different periods, including a period immediately preceding the period of inactivity.

4. The method according to claim 3, further comprising:

calculating the accumulated error value between a target value and a detected change in the toner charge, wherein the toner dispense control value is calculated based on the calculated accumulated error.

5. A xerographic machine performing the method according to claim 1.

6. A system for preventing excess supply of toner in an imaging device, comprising:

a sensor that detects a change in a tribo-electric charge of toner after a period of inactivity of the imaging device;

a calculating section that calculates a toner dispense control value from the detected change in the tribo-electric change of toner using an accumulated error value, a controller that compensates the toner dispense control value based on the detected change in the tribo-electric charge of toner and outputs the compensated toner dispense control value; and wherein the toner dispense control value is a PID (Proportional, Integral, Differential) value, values P, I and D are determined so that the compensated PID value is substantially zero, and the calculating section determines values P, a proportional constant, I, an integral constant, and D, a differential constant, are calculated by the following equations:

$$P(t)=P*\Delta V*e^{-t/\tau}$$

$$I(t)=I*(R*\Delta V+\Delta V*\tau-\Delta V*\tau*e^{-t/\tau})$$

$$D(t)=-D*(\Delta V/\tau)*e^{-t/\tau}$$

where R is a rest recovery constant, ΔV is a change in sensor voltage during rest, t is a measure of the period of inactivity of the imaging device and τ is a time constant, and the PID value is calculated by the following equation:

$$PID=P(t)*E+I(t)*AE+D(t)*\Delta E$$

where E is an error between a target voltage and a measurement voltage of the sensor voltage, AE is an accumulated error of E, and ΔE is a change in error since a last measurement.

7. The system according to claim 6, wherein the sensor detects the change in the tribo-electric charge of toner using a toner concentration (TC) sensor.

8. The system according to claim 6, wherein the toner dispense control value is calculated based on a plurality of changes in the toner charge detected at a plurality of different periods, including a period immediately preceding the period of inactivity.

9. The system according to claim 8, wherein the calculating section calculates the accumulated error value between a target value and a detected change in the toner charge, and wherein the toner dispense control value is calculated based on the calculated accumulated error.

10. A xerographic machine including the system according to claim 6.

11. A program stored in a non-transitory computer readable storage media, the program comprising:

an instruction for receiving a detected change in a tribo-electric charge of toner, with a sensor, after a period of inactivity of the imaging device;

an instruction for compensating a toner dispense control value based on the detected change in the tribo-electric charge of toner;

an instruction for calculating the toner dispense control value from the detected change in the tribo-electric charge of toner using an accumulated error value, an instruction for outputting the compensated toner dispense control value; and wherein the toner dispense control value is determined from a PID value, values P, I and D are such that the compensated toner dispense control value is substantially zero, and the values P, a proportional constant, I, an integral constant, and D, a differential constant, are determined by the following equations:

$$P(t)=P*\Delta V*e^{-t/\tau}$$

$$I(t)=I*(R*\Delta V+\Delta V*\tau-\Delta V*\tau*e^{-t/\tau})$$

$$D(t)=-D*(\Delta V/\tau)*e^{-t/\tau}$$

where R is a rest recovery constant, ΔV is a change in sensor voltage during rest, t is a measure of the period of inactivity of the imaging device and τ is a time constant, and the PID value is calculated by the following equation:

$$PID=P(t)*E+I(t)*AE+D(t)*\Delta E$$

where E is an error between a target voltage and a measurement voltage of the sensor, AE is an accumulated error of E, and ΔE is a change in error since a last measurement.

12. The program according to claim 11, wherein the toner dispense control value is detected using a toner concentration (TC) sensor.

13. The program according to claim 11, wherein the toner dispense control value is calculated based on a plurality of changes in the toner charge detected at a plurality of different periods, including a period immediately preceding the period of inactivity.

14. The program according to claim 13, further comprising:

an instruction for calculating the accumulated error value between a target value and a detected change in the toner charge, wherein the toner dispense control value is calculated based on the calculated accumulated error.

* * * * *